United States Patent [19]

Tokunaga

[11] 4,367,683

[45] Jan. 11, 1983

[54] DRIVELESS VEHICLE WITH SPEED CONTROL

[75] Inventor: Kinjiro Tokunaga, Chiba, Japan

[73] Assignee: SI Handling Systems, Inc., Easton, Pa.

[21] Appl. No.: 217,861

[22] Filed: Dec. 18, 1980

[30] Foreign Application Priority Data

Dec. 18, 1979 [JP] Japan ..... 54-175692[U]

[51] Int. Cl.[3] ..... B61B 13/12

[52] U.S. Cl. ..... 104/166

[58] Field of Search ..... 104/88, 165, 166, 249, 104/250; 198/345, 472, 648; 105/241.2, 268; 74/89, 567

[56] References Cited

U.S. PATENT DOCUMENTS 4,036,148 7/1977 Jones et al. ..... 104/166

4,092,929 6/1978 Laurent ..... 104/173 R

FOREIGN PATENT DOCUMENTS 2919770 11/1980 Fed. Rep. of Germany ..... 104/166

*Primary Examiner*—Randolph Reese

*Attorney, Agent, or Firm*—Seidel, Gonda, Goldhammer & Panitch

[57] ABSTRACT

A friction driven driverless vehicle includes a frame with support wheels adapted to ride on rails. A drive wheel on the frame is provided for frictional contact with a drive shaft parallel to the rails. A motor driven cam is provided on the frame for controlling the position of the drive wheel relative to the drive shaft. The cam is coupled to the drive wheel by a cam follower and linkage.

5 Claims, 9 Drawing Figures

(PRIOR ART)

DRIVELESS VEHICLE WITH SPEED CONTROL

BACKGROUND

Driverless vehicles of the type involved herein are conventionally controlled by cam means exterior of the vehicle. See U.S. Pat. No. 3,356,040 and 3,903,810. Since the cams disclosed in said patents are only at specific locations, the speed of the vehicles can only be controlled at those locations.

The present invention is directed to a solution of the problem of how to selectively control the speed of a driverless vehicle at any location along a track while eliminating the need for a large number of cams along the track.

SUMMARY OF THE INVENTION

The present invention is directed to a driverless vehicle which includes a frame having support wheels for riding on a track. At least one drive wheel is provided on the frame for frictional contact with a drive shaft. The drive wheel is supported on the frame for movement between a drive position and an accumulation position. A motor driven cam is provided on the frame. A means is provided on the frame for coupling the cam to the drive wheel whereby the drive wheel is moved between said drive position and accumulation position. In a preferred embodiment, the last-mentioned means includes a lever pivotably mounted on the frame with a cam follower adjacent one end of the lever and in contact with the cam. The preferred embodiment also includes a linkage connecting the other end of the lever to the drive wheel support.

It is an object of the present invention to provide a driverless vehicle with speed control mounted on the vehicle whereby a large number of cams along the track may be eliminated and at the same type facilitate controlling the speed of the vehicle at desired locations along the track.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION—PRIOR ART

Figure 1:
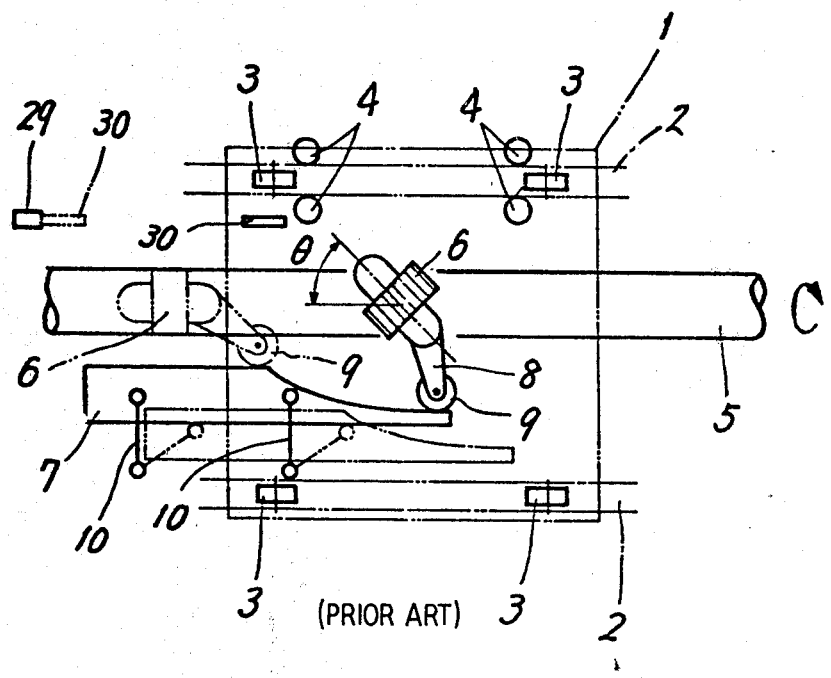
FIG. 1 is a plan view of a prior art driverless vehicle.

Referring to the drawings in detail, wherein like numerals indicate like elements, there is shown in FIG. 1 a diagrammatic plan view of a prior art vehicle of the general type involved herein. The vehicle includes a frame 1 having support wheels 3 on opposite sides thereof. The wheels 3 ride on rails 2. Guide wheels 4 are provided for cooperation with one of the rails 2.

A drive shaft 5 is provided between the rails 2. Shaft 5 is rotatably driven about a longitudinal axis by a motor not shown. A drive wheel is supported by the frame for oscillation about a vertical axis between a drive position as shown in solid lines in FIG. 1 and an accumulation position as shown in phantom lines in FIG. 1. A spring means not shown biases the drive wheel 6 to the drive position wherein the horizontal axis of rotation of wheel 6 forms an angle $\theta$ with the longitudinal axis of the drive shaft 5. In a drive position, angle $\theta$ is approximately 45°.

A ground supported speed control cam 7 is supported in any convenient manner such as by linkage 10 for movement between an operative and an inoperative position. In the operative position, the cam 7 contacts a cam follower 9 at one end of arm 8. Arm 8 is secured to the support for the drive wheel 6 whereby cam 7 causes the drive wheel 6 to pivot from a drive position to an accumulation position. A speed control 7 must be provided at each location where it is desired to cause the vehicle to stop or accumulation. At each such location, there may be provided a movable limit stop 29 for physically contacting a stationary limit stop 30 on the lower surface of the frame of the vehicle whereby the speed control cam may be retracted to an inoperative position but the vehicle will not move until limit stop 29 is removed.

DETAILED DESCRIPTION—PRESENT INVENTION

Figure 2:
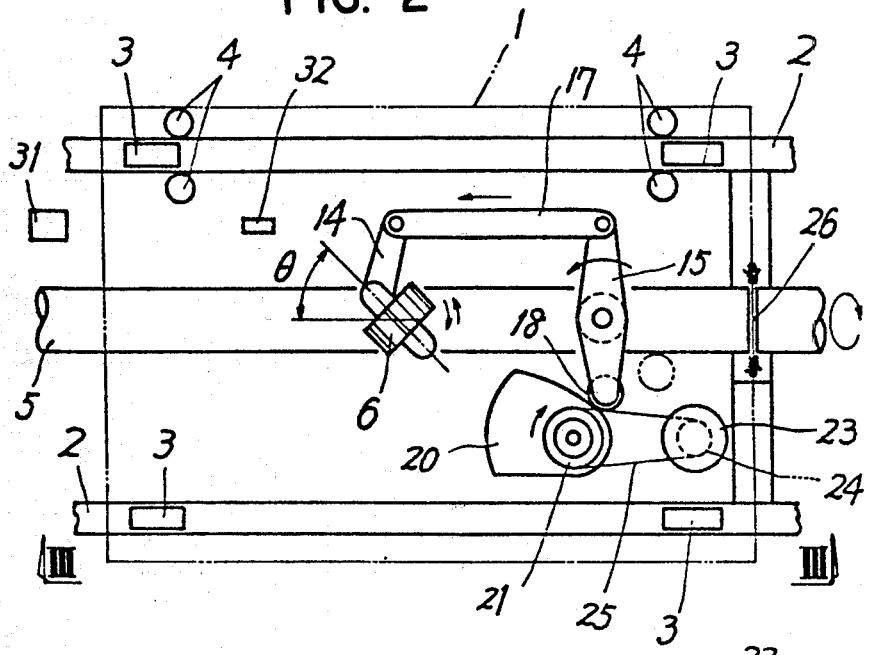
FIG. 2 is a diagrammatic plan view of the vehicle of the present invention.
Figure 3:
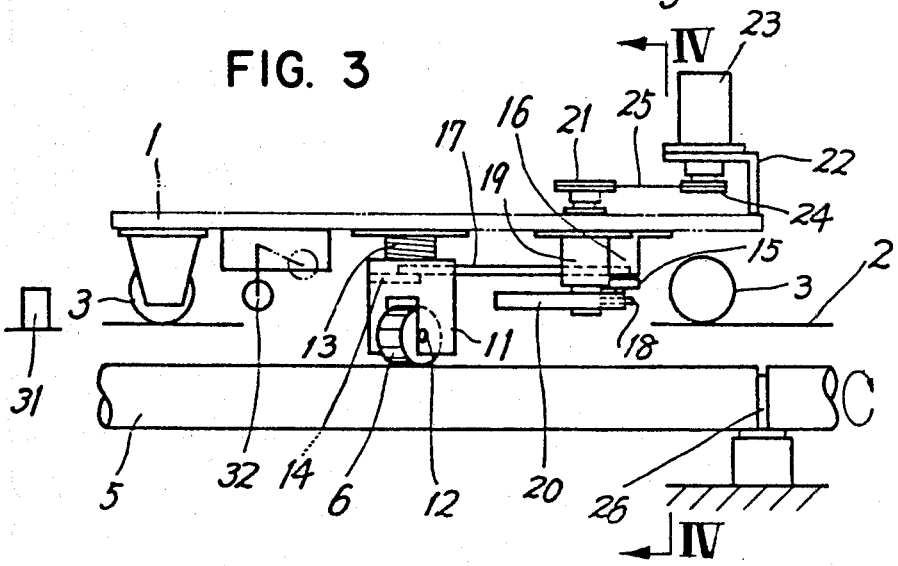
FIG. 3 is a side elevation view of the vehicle shown in FIG. 2.
Figure 4:
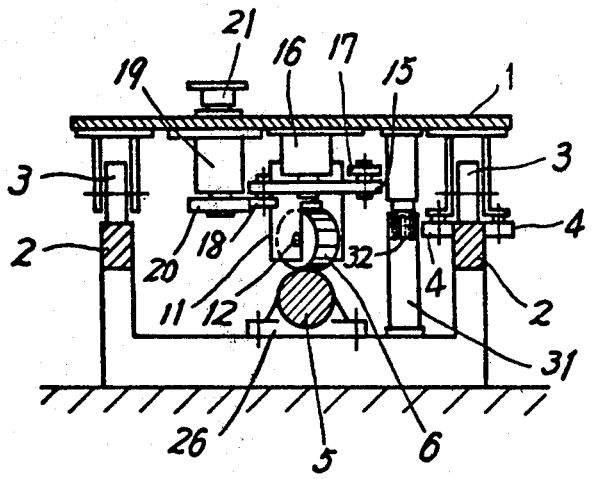
FIG. 4 is a sectional view taken along the line 4—4 in FIG. 3.

Referring to FIGS. 2–6, there is illustrated a first embodiment of the present invention wherein corresponding elements are provided with corresponding numerals. As shown more clearly in FIG. 3, the drive wheel 6 rotates about a horizontally disposed axle 12 supported by the yoke 11. Yoke 11 is biased to a drive position for the wheel 6 by torsion spring 13. As shown in FIG. 2, one end of an arm 14 is fixedly secured to the yoke 11. The other end of arm 14 is pivotably connected to one end of a lever 15 by way of a connecting rod 17. The lever 15 is supported for pivotable movement about a vertical axis by means of the bearing housing 16 depending from the bottom surface of the frame as shown more clearly in FIG. 4. The other end of lever 15 is provided with a cam follower 18 in contact with a cam 20.

The cam 20 is rotatably supported for movement about a vertical axis by way of a bearing housing 19. Bearing housing 19 is supported from the bottom surface of the frame as shown more clearly in FIG. 4. On the same shaft as the cam 20, there is provided a pulley 21. As shown more clearly in FIG. 3, pulley 21 is supported by the upper surface of frame 1.

A bracket 22 at the front end of the frame 1 supports a motor 23. Motor 23 has a pulley 24 on its output shaft. Pulleys 21 and 24 are interconnected by a belt 25. Pulleys 21 and 24 could be sprockets interconnected by a chain. In place of stationary limit stop, the frame is provided on its lower surface with a manually adjustable limit stop 32 which, when in its lowermost or operative position, will contact the movable limit stop 31 supported by the ground.

Figure 5:
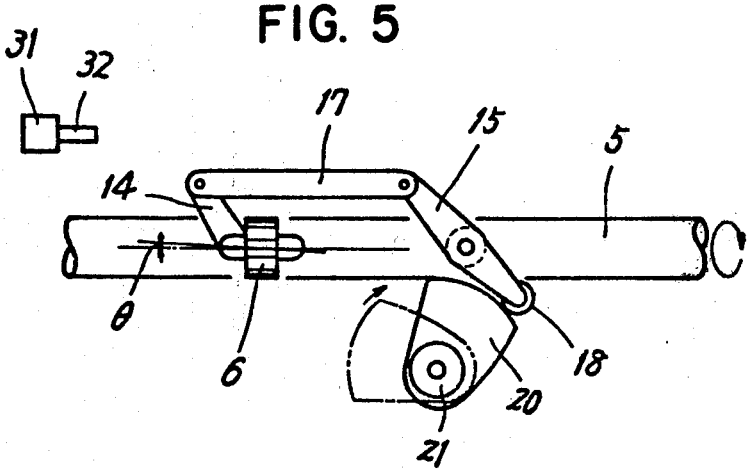
FIG. 5 is a plan view of components which control the position of the drive wheel.
Figure 6:
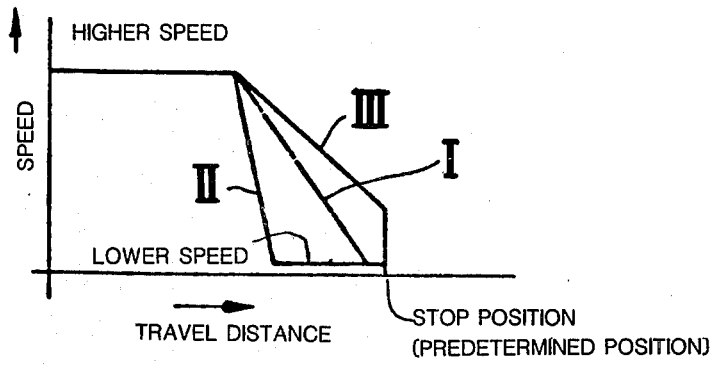
FIG. 6 is a graph showing change of speed of the vehicle as a function of distance.

Motor 23 may be actuated in any one of a wide variety of manners. Motor 23 could be a constant speed battery operated gear motor with a timer which is manually set or electronically tripped as the vehicle is moving along the tracks. When the timer times out, the motor 23 will drive the cam 20 to cause the drive wheel 6 to pivot from the solid line position shown in FIG. 2 which is the drive position to the accumulation position as shown in FIG. 5. If desired, motor 23 could be a constant speed A.C. gear motor which is rendered operative by contact with a bus bar at desired locations along the tracks. Control switches or a single revolution clutch may be used to temporarily disconnect the driving effect of motor 23 on cam 20.

As shown in FIG. 5, the longitudinal axis of axle 12 is parallel to or almost parallel to the longitudinal axis of drive shaft 5. Thus, it is possible to cause the vehicle to stop or accumulate at any desired location along the track. The deceleration of the vehicle may follow any of the three lines designated with Roman numerals in FIG. 6 depending upon the shape of the cam 20 and the speed with which it is driven by the motor 23. Acceleration and deceleration are controlled by the shape of cam 20 and not by the speed of motor 23.

Figure 7:
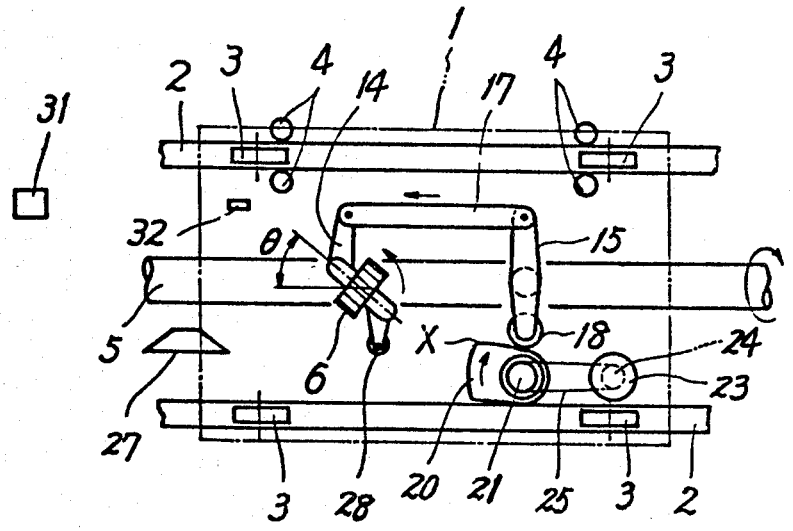
FIG. 7 is a diagrammatic plan view of another embodiment of the present invention.
Figure 8:
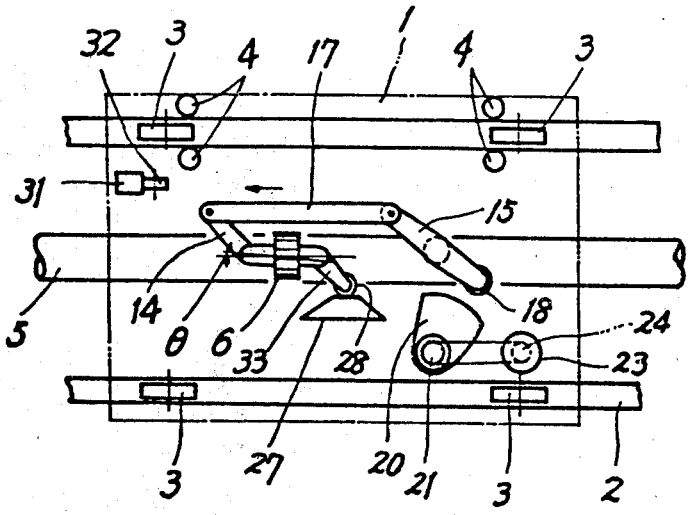
FIG. 8 is a view similar to FIG. 7 but showing the components in a different position.
Figure 9:
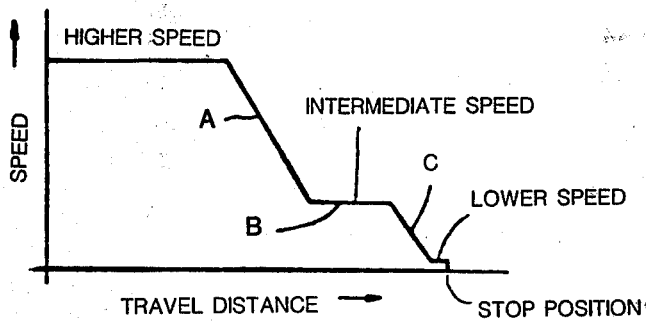
FIG. 9 is a graph showing change of speed versus distance in connection with the vehicle of the second embodiment.

In FIGS. 7 and 8, there is shown a second embodiment of the present invention which is identical with that described above except as will be made clear hereinafter. As shown in FIG. 7, the yoke 11 is provided with an extension arm terminating in a cam follower 28 in a manner similar to that disclosed in FIG. 1. Cam follower 28 is adapted to contact a cam 27 supported alongside the tracks 2. The motor 23 can be triggered to commence with slowing down of the vehicle in accordance with the graph shown in FIG. 9. As shown in FIG. 9, the cam 20 is utilized to slow the vehicle down as indicated by line A to an intermediate speed B. Thereafter, cam follower 28 will contact the speed control cam 27 and take over the control of deceleration along line C in FIG. 9. See FIG. 8 wherein cam follower 18 no longer contacts cam 20 when cam follower 28 is in contact with cam 27. The second embodiment of the present invention can be used on conventional tracks having conventional speed control cams 27.

As shown in FIG. 8, cam follower 28 is on a dwell of cam 27. The angle $\theta$ is close to zero but the vehicle is stationary due to contact between limit stops 31, 32. When it is desired to have the vehicle more forward, limit stop 32 is manually or in some other manner retracted to the inoperative position shown in phantom in FIG. 3. Thereafter, the cam follower will slowly move off the dwell on cam 27 and acelerate.

The present invention may be embodied in other specific forms without departing from the spirit or essential attributes thereof and, accordingly, reference should be made to the appended claims, rather than to the foregoing specification, as indicating the scope of the invention.

I claim:

1. A driverless vehicle comprising a frame having support wheels for riding on a track, at least one drive wheel on the frame for frictional contact with a drive shaft, said drive wheel being supported for movement between a drive position and an accumulation position, the improvement comprising a motor driven cam on said frame, and means on the frame for coupling the cam to the drive wheel whereby the drive wheel is moved between said positions by said cam.

2. A vehicle in accordance with claim 1 wherein the last-mentioned means includes a lever pivotably mounted on the frame, a cam follower adjacent one end of the lever and in contact with said cam, and linkage connecting the other end of said lever to said drive wheel.

3. A vehicle in accordance with claim 2 including a cantilever arm coupled to the drive wheel and terminating in a cam follower for contact with a ground supported speed control cam.

4. A vehicle in accordance with claim 1 wherein the motor is supported by the upper surface of the frame and said cam is supported from the lower surface of the frame, means including a vertical shaft for coupling said motor to said cam.

5. A vehicle in accordance with any one of claims 1–4 wherein said motor is an electrical motor.

* * * * *